US010627746B2

(12) United States Patent
Murakami

(10) Patent No.: US 10,627,746 B2
(45) Date of Patent: Apr. 21, 2020

(54) IMAGE FORMING DEVICE AND STORAGE MEDIUM

(71) Applicant: Konica Minolta, Inc., Chiyoda-ku, Tokyo (JP)

(72) Inventor: Daisuke Murakami, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/387,444

(22) Filed: Apr. 17, 2019

(65) Prior Publication Data

US 2019/0354041 A1 Nov. 21, 2019

(30) Foreign Application Priority Data

May 17, 2018 (JP) ..... 2018-095018

(51) Int. Cl.
*G03G 15/16* (2006.01)

(52) U.S. Cl.
CPC ... *G03G 15/161* (2013.01); *G03G 2215/0122* (2013.01); *G03G 2215/1614* (2013.01)

(58) Field of Classification Search
CPC ..... G03G 15/1615; G03G 15/5029; G03G 15/161
See application file for complete search history.

(56) References Cited

U.S. PATENT DOCUMENTS

2014/0241744 A1* 8/2014 Ichikawa ..... G03G 15/1615 399/66
2017/0235258 A1* 8/2017 Wada ..... G03G 15/5029 399/66
2017/0299987 A1* 10/2017 Sugimoto ..... G03G 15/1605
2018/0011429 A1* 1/2018 Mizumoto ..... G03G 15/1615

FOREIGN PATENT DOCUMENTS

JP 2010-139955 A 6/2010

* cited by examiner

*Primary Examiner* — Sevan A Aydin
(74) *Attorney, Agent, or Firm* — Squire Patton Boggs (US) LLP

(57) ABSTRACT

An image forming device of an intermediate transfer method of transferring a toner image formed on an image carrier to a sheet of paper through an intermediate transfer body, the image forming device including a transfer roller which is disposed facing the image carrier across the intermediate transfer body, and which forms a nip part with the image carrier; a movement mechanism which moves the transfer roller in a direction along a movement direction of the intermediate transfer body; a pressure varying mechanism which changes a pressing force of the transfer roller on the intermediate transfer body; and a hardware processor which controls the movement mechanism and the pressure varying mechanism, and which sets a contact position and the pressing force of the transfer roller on the intermediate transfer body based on paper information of the sheet of paper as an image formation target.

8 Claims, 6 Drawing Sheets

IMAGE FORMING DEVICE AND STORAGE MEDIUM

BACKGROUND

Technological Field

The present invention relates to an image forming device and a storage medium.

Description of the Related Art

Conventionally, an image forming device of an intermediate transfer method is widespread, which primarily transfers a toner image formed on a photoreceptor (image carrier) to an intermediate transfer belt (intermediate transfer body), and which secondarily transfers the toner image on the intermediate transfer belt to a sheet of paper.

With such an image forming device, an image defect is sometimes caused because of discharge between the photoreceptor and a primary transfer roller, which are arranged facing each other across the intermediate transfer belt. For example, an image defect is white spots caused because of a toner which lost charges by discharge not being transferred, or wavy color unevenness (ripple) caused by toner, a polarity of charges of which is reversed by discharge, being collected at a primary transfer unit on a downstream side.

To prevent such an image defect, normally, the primary transfer roller of the image forming device is arranged shifted, with respect to the photoreceptor, to the downstream side in a movement direction of the intermediate transfer belt. As shown in FIG. 6A, according to such an arrangement, a primary transfer roller 61 presses an intermediate transfer belt 62 by a predetermined pressing force, and thus, the intermediate transfer belt 62 is wrapped around a photoreceptor 63 and a primary transfer nip part N1 is formed.

Now, in recent years, there is a demand to form, by such an image forming device, an image on a sheet of paper having an uneven surface (uneven paper), such as embossed paper or rough paper.

With uneven paper, a toner does not easily reach recessed parts at the time of secondary transfer, and a secondary transfer property is known to be reduced compared to normal paper.

Accordingly, with respect to image formation on uneven paper, there is proposed a technique of reducing the pressing force of a primary transfer roller on an intermediate transfer belt than in a normal case and enabling a toner on the intermediate transfer belt to be easily peeled off from the belt to thereby increase the secondary transfer property for the recessed parts of the uneven paper (for example, see Japanese Patent Laid-Open No. 2010-139955).

However, in the arrangement as described above where the primary transfer roller is shifted, with respect to the photoreceptor, to the downstream side in the movement direction of the intermediate transfer belt, when the pressing force of the primary transfer roller is reduced, the primary transfer roller 61 is pushed back by tension of the intermediate transfer belt 62, as shown in FIG. 6B and the primary transfer nip part N1 is not formed, and there is a problem that a primary transfer property is drastically reduced.

SUMMARY

An object of the present invention is to maintain desirable primary transfer property and secondary transfer property for an image forming device of an intermediate transfer method, regardless of the type of paper.

To achieve at least one of the abovementioned objects, according to a first aspect of the present invention, an image forming device reflecting one aspect of the present invention is an image forming device of an intermediate transfer method of transferring a toner image formed on an image carrier to a sheet of paper through an intermediate transfer body, the image forming device including:

a transfer roller which is disposed facing the image carrier across the intermediate transfer body, and which forms a nip part with the image carrier;

a movement mechanism which moves the transfer roller in a direction along a movement direction of the intermediate transfer body;

a pressure varying mechanism which changes a pressing force of the transfer roller on the intermediate transfer body; and a hardware processor which controls the movement mechanism and the pressure varying mechanism, and which sets a contact position and the pressing force of the transfer roller on the intermediate transfer body based on paper information of the sheet of paper as an image formation target.

According to a second aspect of the present invention, a storage medium reflecting one aspect of the present invention is a non-transitory computer readable storage medium storing a program which is executed by a computer of an image forming device of an intermediate transfer method of transferring a toner image formed on an image carrier to a sheet of paper through an intermediate transfer body, the image forming device including:

a transfer roller which is disposed facing the image carrier across the intermediate transfer body, and which forms a nip part with the image carrier, a movement mechanism which moves the transfer roller in a direction along a movement direction of the intermediate transfer body, and a pressure varying mechanism which changes a pressing force of the transfer roller on the intermediate transfer body, where the program causes the computer to perform controlling the movement mechanism and the pressure varying mechanism, and setting a contact position and the pressing force of the transfer roller on the intermediate transfer body based on paper information of the sheet of paper as an image formation target.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

[Configuration of Image Forming Device]

First, a configuration of an image forming device according to a present embodiment will be described.

The image forming device according to the present embodiment is a color image forming device of an intermediate transfer method that uses an electrophotographic process technique.

Figure 1:
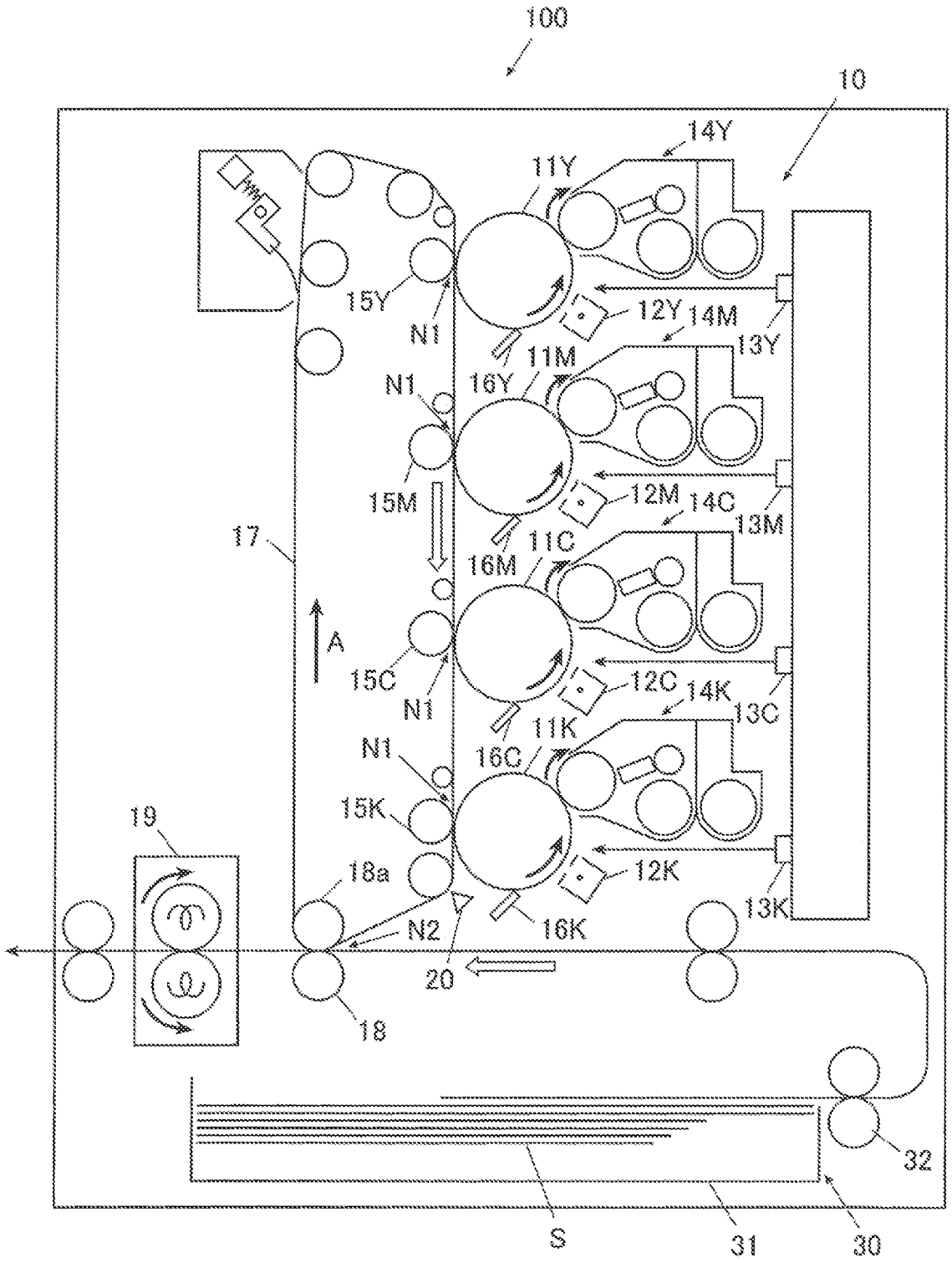
FIG. 1 is a diagram showing a schematic configuration of an image forming device according to a present embodiment.
Figure 2:
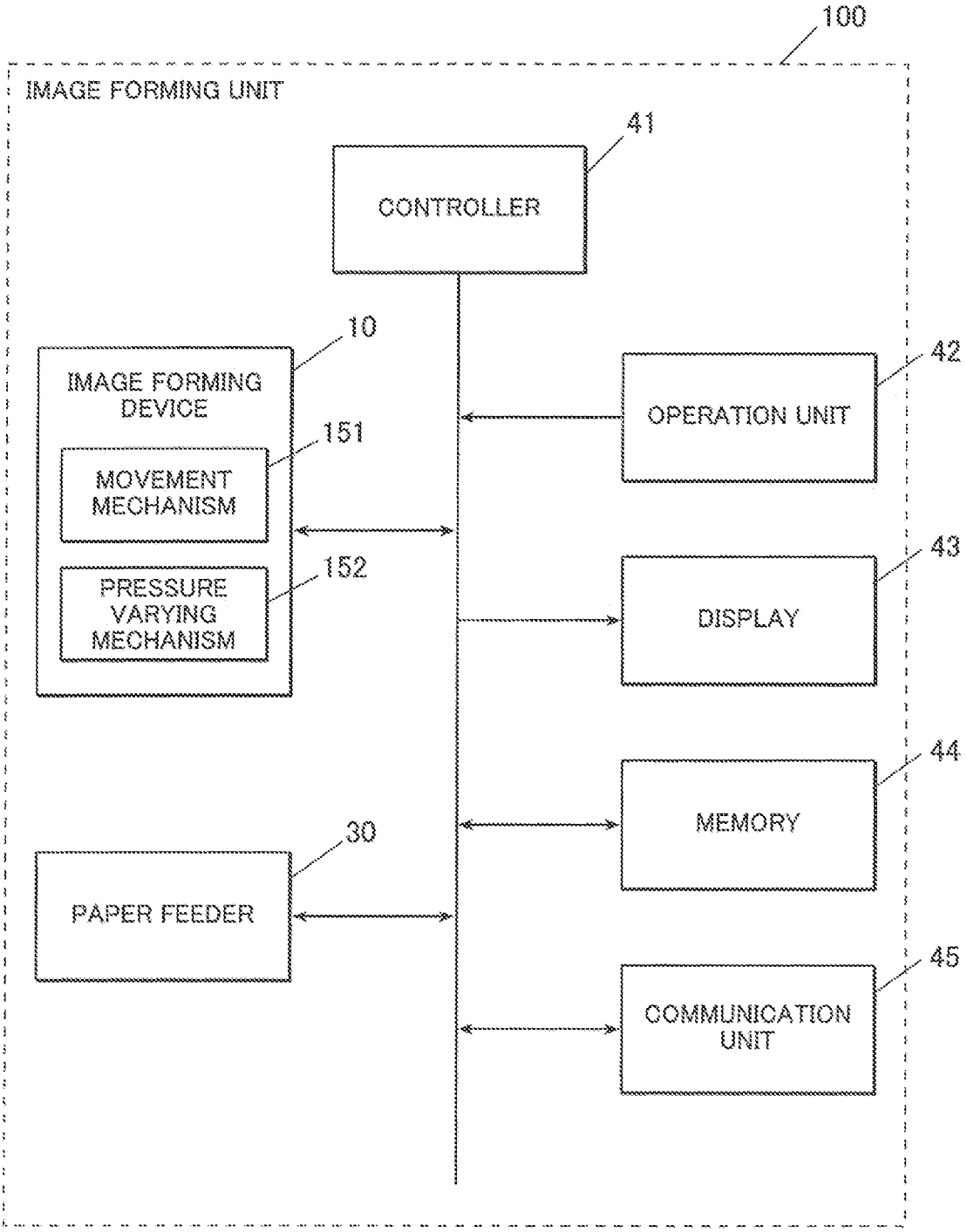
FIG. 2 is a block diagram showing a main functional configuration of the image forming device.

FIG. 1 is a schematic configuration diagram of an image forming device 100. FIG. 2 is a block diagram showing a functional configuration of the image forming device 100.

As shown in FIGS. 1 and 2, the image forming device 100 includes an image forming unit 10, a paper feeder 30, a controller 41, an operation unit 42, a display 43, a memory 44, a communication unit 45, and the like, and each unit is connected by a bus.

The image forming unit 10 includes photoreceptors (image carrier) 11Y, 11M, 11C, 11K, chargers 12Y, 12M, 12C, 12K, exposure units 13Y, 13M, 13C, 13K, developer units 14Y, 14M, 14C, 14K, primary transfer rollers 15Y, 15M, 15C, 15K, and photoreceptor cleaners 16Y, 16M, 16C, 16K corresponding to respective colors among yellow (Y), magenta (M), cyan (C) and black (K), and an intermediate transfer belt (intermediate transfer body) 17, a secondary transfer roller 18, a fixer 19, and a sensor 20.

The photoreceptors 11Y, 11M, 11C, 11K are each an organic photoreceptor where a photosensitive layer of resin containing organic photoconductor is formed on an outer peripheral surface of a drum-shaped metallic base. Additionally, in the following description, the photoreceptors 11Y, 11M, 11C, 11K are sometimes collectively referred to as the photoreceptor(s) 11.

The chargers 12Y, 12M, 12C, 12K charge the photoreceptors 11Y, 11M, 11C, 11K to a specific potential of a negative polarity by using an electrifying charger.

The exposure units 13Y, 13M, 13C, 13K include a laser light source, a polygon mirror, a lens, and the like, and scan and expose a surface of the photoreceptors 11Y, 11M, 11C, 11K by a laser beam based on image data of each color, and form an electrostatic latent image.

The developer units 14Y, 14M, 14C, 14K include a developer sleeve that is arranged facing the photoreceptors 11Y, 11M, 11C, 11K across a development area. For example, a development bias obtained by superimposing an AC voltage on a DC voltage of a same polarity as a charge polarity of the chargers 12Y, 12M, 12C, 12K, or in other words, a negative polarity, is applied to the developer sleeve, and a developer is thereby supplied onto the electrostatic latent image formed on the photoreceptors 11Y, 11M, 11C, 11K, and a toner image of each color is formed on the photoreceptors 11Y, 11M, 11C, 11K. The developer includes a toner, and a carrier for charging the toner. The toner is not particularly limited, and a known toner that is generally used may be used.

The primary transfer rollers 15Y, 15M, 15C, 15K are arranged facing the photoreceptors 11Y, 11M, 11C, 11K across the intermediate transfer belt 17 to form the primary transfer nip part N1, and sequentially transfer the toner image of each color formed on the photoreceptors 11Y, 11M, 11C, 11K to the intermediate transfer belt 17 (primary transfer). A color toner image superimposing toner images of four colors is thereby formed on the intermediate transfer belt 17. In the following description, the primary transfer rollers 15Y, 15M, 15C, 15K are sometimes collectively referred to as the primary transfer roller(s) 15.

The photoreceptor cleaners 16Y, 16M, 16C, 16K remove the toner remaining on a peripheral surface of the photoreceptors 11Y, 11M, 11C, 11K after transfer is performed.

The intermediate transfer belt 17 is an endless belt stretched by a plurality of rollers (drive roller, tension roller, driven roller), and is driven to circulate in a direction indicated by an arrow A in FIG. 1. The intermediate transfer belt 17 is not particularly limited with respect to material or thickness as long as a desired transfer property is obtained.

The secondary transfer roller 18 is arranged in contact with a counter roller 18*a* across the intermediate transfer belt 17 to form a secondary transfer nip part N2, and transfers the color toner image formed on the intermediate transfer belt 17 collectively to one surface of a sheet of paper S supplied from the paper feeder 30 (secondary transfer).

The fixer 19 fixes the toner transferred to the sheet of paper S, on the sheet of paper S by heating/pressurization.

The sensor 20 is arranged at a predetermined position which is on a downstream side of the primary transfer nip part N1 of black (K), which is on the most downstream side in the movement direction of the intermediate transfer belt 17, and which is before the secondary transfer nip part N2, for example. The sensor 20 reads the toner image formed on the intermediate transfer belt 17 by an image sensor such as a charge coupled device (CCD), and acquires image information which is used to correct an image density at the time of image formation or to optimize conditions of image formation, for example.

A configuration of the primary transfer roller 15 will be described in detail.

Figure 3A:
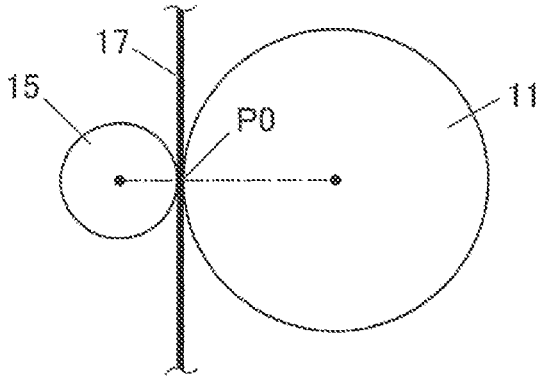
FIG. 3A is an enlarged schematic diagram showing a primary transfer roller and its periphery.
Figure 3B:
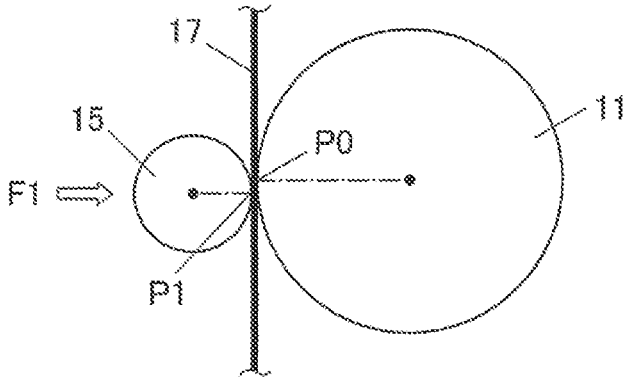
FIG. 3B is an enlarged schematic diagram showing the primary transfer roller and its periphery.
Figure 3C:
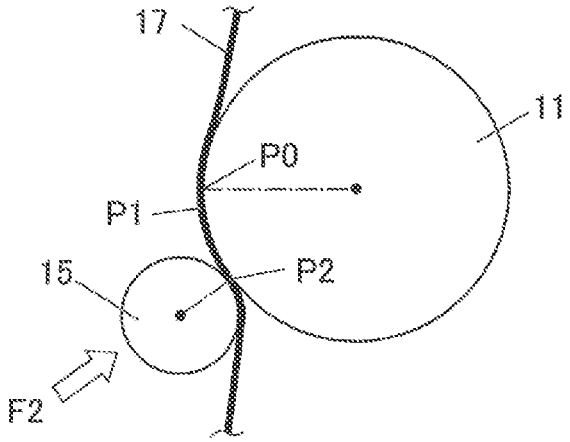
FIG. 3C is an enlarged schematic diagram showing the primary transfer roller and its periphery.

FIGS. 3A to 3C are enlarged schematic diagrams showing the primary transfer roller 15 and its periphery.

As described above, the primary transfer roller 15 is arranged facing the photoreceptor 11 across the intermediate transfer belt 17.

The primary transfer roller 15 of the present embodiment includes a movement mechanism 151 (see FIG. 2) which moves the primary transfer roller 15 in a direction along the movement direction of the intermediate transfer belt 17. That is, a contact position of the primary transfer roller 15 on the intermediate transfer belt 17 (hereinafter simply referred to as the "contact position of the primary transfer roller 15") may be changed by the movement mechanism 151.

For example, the movement mechanism 151 includes a cam which moves a holder provided at a rotary shaft of the primary transfer roller 15, and a driver which drives the cam, and the rotary shaft, and therefore, the primary transfer roller 15, may be moved by a predetermined distance by driving the cam by the driver by a predetermined amount.

Specifically, in the present embodiment, the contact position of the primary transfer roller 15 may be switched to three positions of a reference position P0 (first position), a position P1 (predetermined position), and a position P2 (second position).

As shown in FIG. 3A, the reference position P0 is a position at which a straight line (dash-dotted line) joining a rotation center of the primary transfer roller 15 and a rotation center of the photoreceptor 11 becomes perpendicular to the intermediate transfer belt 17.

As shown in FIG. 3B, the position P1 is a position which is shifted from the reference position P0 by a predetermined distance to be on the downstream side in the movement direction of the intermediate transfer belt 17.

As shown in FIG. 3C, the position P2 is a position which is further shifted by a predetermined distance to be on the downstream side of the position P1.

For example, the position P1 is a position which is 0.5 mm to the downstream side of the reference position P0 in the movement direction of the intermediate transfer belt 17, and the position P2 is a position which is 5 mm to the downstream side of the reference position P0 in the movement direction of the intermediate transfer belt 17.

The primary transfer roller 15 is applied with a predetermined pressing force to press the intermediate transfer belt 17 (photoreceptor 11), and the primary transfer nip part N1 is thereby formed between the primary transfer roller 15 and the photoreceptor 11.

The primary transfer roller 15 of the present embodiment includes a pressure varying mechanism 152 (see FIG. 2) which changes the pressing force of the primary transfer roller 15 on the intermediate transfer belt 17 (hereinafter simply referred to as the "pressing force of the primary transfer roller 15"). For example, the pressure varying mechanism 152 includes a biasing member, such a spring, which biases the primary transfer roller 15, and a driver which changes a biasing force of the biasing member, and the force by which the primary transfer roller 15 presses the intermediate transfer belt 17 may be changed by changing the biasing force of the biasing member by the driver.

Specifically, the pressing force of the primary transfer roller 15 is switched according to the contact position of the primary transfer roller 15. In the case where the contact position of the primary transfer roller 15 is the position P1, the pressing force of the primary transfer roller 15 is set to a predetermined pressing force F1, and in the case where the contact position of the primary transfer roller 15 is the position P2, the pressing force of the primary transfer roller 15 is set to a pressing force F2 greater than the pressing force F1.

For example, the pressing force F1 is 1 N, and the pressing force F2 is 10 N.

Accordingly, the more separate the contact position of the primary transfer roller 15 is from the reference position P0, the greater the pressing force of the primary transfer roller 15, and the greater the force of bringing the primary transfer roller 15 closer to the photoreceptor 11. Moreover, the closer the contact position of the primary transfer roller 15 to the reference position P0, the smaller the pressing force of the primary transfer roller 15, and the smaller the force of bringing the primary transfer roller 15 closer to the photoreceptor 11.

In this manner, because the primary transfer roller 15 presses the intermediate transfer belt 17 with a pressing force that is according to the contact position, the primary transfer nip part N1 is formed between the primary transfer roller 15 and the photoreceptor 11 at any of the contact positions.

Referring back to FIGS. 1 and 2, the paper feeder 30 is provided at a lower part of the image forming device 100, and includes a detachable paper feed cassette 31. The sheets of paper S housed in the paper feed cassette 31 are fed to a feeding route by a paper feed roller 32, one by one from the sheet of paper at the top.

The controller 41 includes a central processing unit (CPU), a read only memory (ROM), a random access memory (RAM), and the like, and controls a processing operation of each unit of the image forming device 100 in an overall manner. The CPU reads various processing programs stored in the ROM and develops the programs in the RAM, and performs various processes according to the developed programs.

For example, at the time of image formation on the sheet of paper S, the controller 41 performs a process of adjusting, according to paper information, the contact position and the pressing force of the primary transfer roller 15 on the intermediate transfer belt 17 (primary transfer roller adjustment process).

The operation unit 42 includes a touch panel formed to cover a display screen of the display 43, and various operation buttons such as number buttons and a start button, and outputs an operation signal based on a user operation to the controller 41.

The display 43 includes a liquid crystal display (LCD), and displays various screens according to instructions of display signals input from the controller 41.

The memory 44 is a storage device such as a non-volatile semiconductor memory or a hard disk, and stores data and the like related to various processes.

The communication unit 45 exchanges data with an external device connected to a network such as a local area network (LAN).

[Primary Transfer Roller Adjustment Process]

Next, an operation of the image forming device 100 will be described.

The image forming device 100 of the present embodiment achieves desirable primary transfer property and secondary transfer property by performing, at the time of forming an image on the sheet of paper S, a primary transfer roller adjustment process of adjusting the contact position and the pressing force of the primary transfer roller 15 on the intermediate transfer belt 17 according to the paper information of the sheet of paper S as an image formation target.

Figure 4:
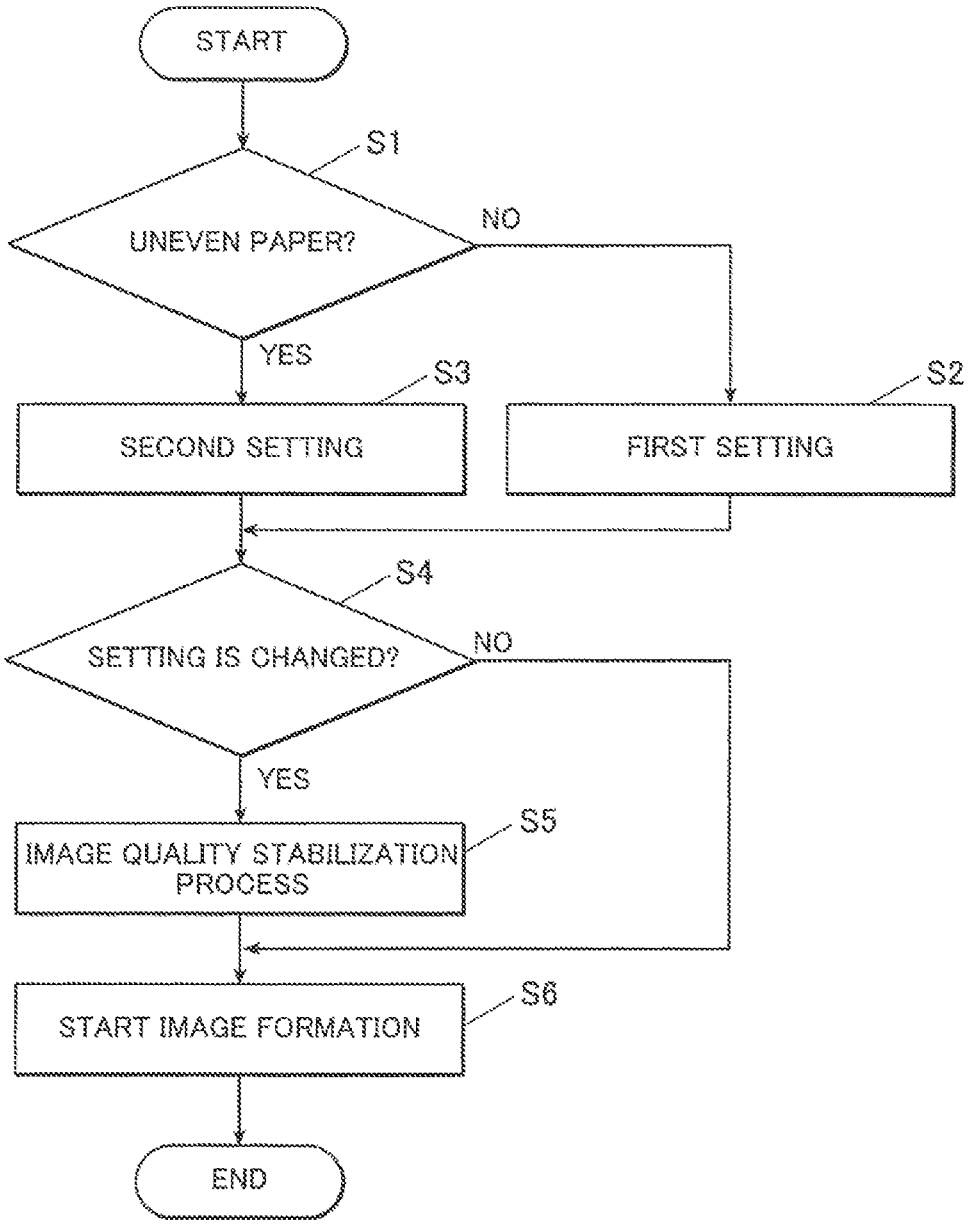
FIG. 4 is a flowchart showing a primary transfer roller adjustment process.

FIG. 4 is a flowchart showing the primary transfer roller adjustment process. This process is performed upon reception of an image formation job.

As shown in FIG. 4, first, the controller 41 determines whether the sheet of paper S as an image formation target is a sheet of paper with an uneven surface (step S1).

A "sheet of paper with an uneven surface (hereinafter referred to as "uneven paper")" is a sheet of paper with a surface roughness of 10 μm or more, for example, and may be embossed paper or rough paper.

The controller 41 determines whether the sheet of paper S as the image formation target is uneven paper or not, based on the paper information which is specified by a user before execution of an image formation process.

Additionally, whether the sheet of paper S as the image formation target is uneven paper or not may be determined by providing an optical sensor at the paper feed cassette 31, a feeding route, or the like, and by detecting, by the optical sensor, the surface roughness of the sheet of paper S used for image formation.

In the case where the sheet of paper S is not determined to be uneven paper (step S1: NO), the controller 41 controls the primary transfer roller 15 to a "first setting" (step S2).

The "first setting" is a setting in which the contact position of the primary transfer roller 15 is P2 (5 mm downstream of the reference position P0) and the pressing force of the primary transfer roller 15 is F2 (10 N).

On the other hand, in the case where the sheet of paper S is determined to be uneven paper (step S1: YES), the controller 41 controls the primary transfer roller 15 to a "second setting" (step S3).

The "second setting" is a setting in which the contact position of the primary transfer roller 15 is P1 (0.5 mm downstream of the reference position P0) and the pressing force of the primary transfer roller 15 is F1 (1 N).

Additionally, the contact position in the "second setting" may be the reference position P0, but in the present embodiment, the contact position is set to the position P1 (0.5 mm on the downstream side) to prevent the position of the primary transfer roller 15 from being moved to an upstream side of the photoreceptor 11 by an influence from tolerance. In the case where the contact position in the "second setting" is the reference position P0, a pressing force F0 smaller than the pressing force F1 is set for the reference position P0.

Next, the controller 41 determines whether the setting of the primary transfer roller 15 (the contact position and the pressing force of the primary transfer roller 15) is changed from previous image formation (step S4).

Then, in the case where a change is determined (step S4: YES), the controller 41 performs an image quality stabilization process (step S5).

Specifically, the controller 41 detects, by the sensor 20, density of the toner image formed on the intermediate transfer belt 17, and adjusts the development bias such that a value of the density becomes predetermined density.

This is a process that is performed to prevent a change in density of an image formed on the sheet of paper S which is caused by a change in the primary transfer property and the secondary transfer property due to a change in the setting of the primary transfer roller 15.

On the other hand, in the case where no change is determined in step S4 (step S4: NO), or after the image quality stabilization process in step S5 is ended, the controller 41 issues an instruction to start image formation on the sheet of paper S (step S6), and the present process is ended.

Figure 5A:
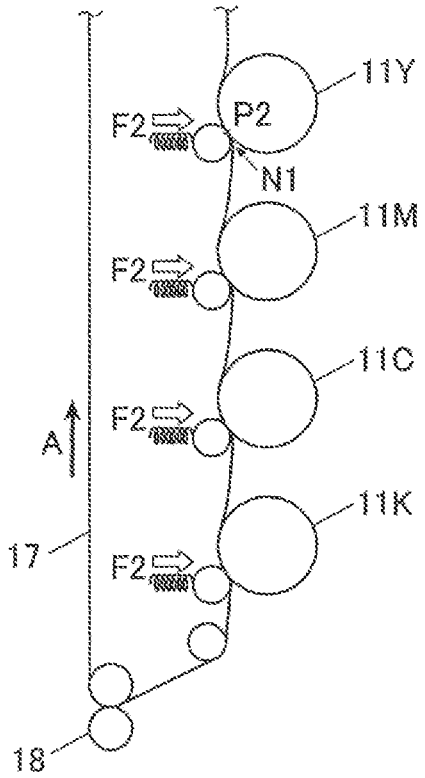
FIG. 5A is a diagram for describing a state of the primary transfer roller in the primary transfer roller adjustment process.

FIG. 5A is a schematic diagram showing the primary transfer roller 15 and the intermediate transfer belt 17 in a case of the "first setting" (case where the image formation target is not uneven paper).

As shown in FIG. 5A, in the case of forming an image on the sheet of paper S which is not uneven paper, the primary transfer roller 15 is arranged on the downstream side of the photoreceptor 11 in the movement direction of the intermediate transfer belt 17 (position P2), and a sufficient pressing force (pressing force F2) is applied, and thus, the intermediate transfer belt 17 is wrapped around the photoreceptor 11, and the primary transfer nip part N1 is formed.

Accordingly, occurrence of an image defect that is caused by discharge between the photoreceptor 11 and the primary transfer roller 15 may be suppressed, and a desirable image may be obtained.

Figure 5B:
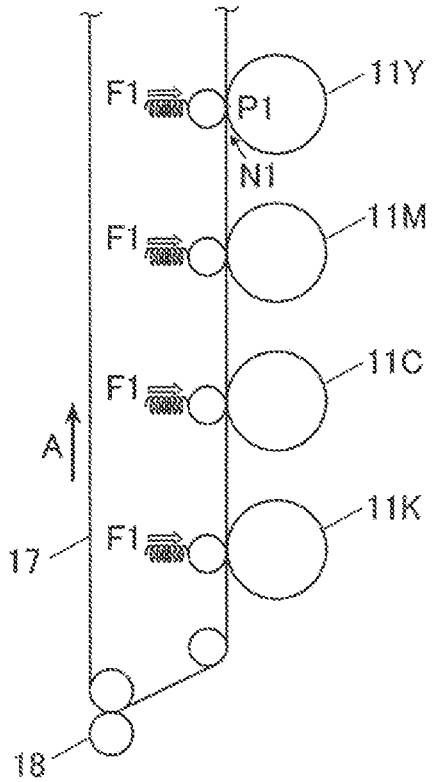
FIG. 5B is a diagram for describing the state of the primary transfer roller in the primary transfer roller adjustment process.
Figure 6A:
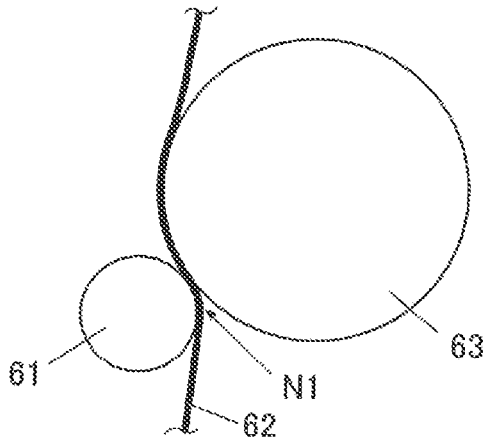
FIG. 6A is a diagram for describing a conventional problem.
Figure 6B:
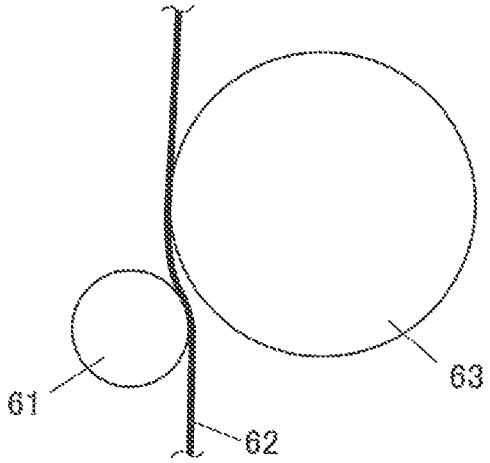
FIG. 6B is a diagram for describing the conventional problem.

FIG. 5B is a schematic diagram showing the primary transfer roller 15 and the intermediate transfer belt 17 in a case of the second setting (case where the image formation target is uneven paper).

As shown in FIG. 5B, in the case of forming an image on uneven paper, an image defect (such as a white spot or a ripple) which is possibly caused on a sheet of paper other than uneven paper is not very noticeable, and thus, the primary transfer roller 15 is brought closer to the photoreceptor 11 compared to a case of a sheet of paper other than uneven paper (position P1). Furthermore, the pressing force of the primary transfer roller 15 is reduced (pressing force F1) than in a case of a sheet of paper other than uneven paper, and the toner on the intermediate transfer belt 17 is allowed to be easily peeled off at the time of secondary transfer.

Accordingly, with uneven paper for which an image defect is not very noticeable, a desirable secondary transfer property may be achieved with respect to recessed parts of uneven paper while maintaining contact between the primary transfer roller 15 and the photoreceptor 11, and a desirable image may be obtained.

Advantageous Effects of Present Embodiment

As described above, according to the present embodiment, the image forming device 100 is the image forming device 100 of an intermediate transfer method of transferring a toner image formed on the photoreceptor 11 to the sheet of paper S through the intermediate transfer belt 17, and includes the primary transfer roller 15 which is disposed facing the photoreceptor 11 across the intermediate transfer belt 17, and which forms the primary transfer nip part N1 with the photoreceptor 11, the movement mechanism 151 which moves the primary transfer roller 15 in a direction along the movement direction of the intermediate transfer belt 17, the pressure varying mechanism 152 which changes the pressing force of the primary transfer roller 15 on the intermediate transfer belt 17, and the controller 41 which controls the movement mechanism 151 and the pressure varying mechanism 152, and which sets the contact position and the pressing force of the primary transfer roller 15 on the intermediate transfer belt 17 based on the paper information of the sheet of paper S as the image formation target.

Accordingly, because the contact position and the pressing force of the primary transfer roller 15 are changed depending on the sheet of paper S as the image formation target, desirable primary transfer property and secondary transfer property may be maintained regardless of the type of the sheet of paper.

Furthermore, according to the present embodiment, the controller 41 is capable of changing the contact position of the primary transfer roller 15 between the reference position P0 and the position P2 by controlling the movement mechanism 151, and controls the pressure varying mechanism 152 and reduces the pressing force as the contact position is brought closer from the position P2 to the reference position P0.

Accordingly, the pressing force may be changed stepwise according to the contact position.

Furthermore, according to the present embodiment, the controller 41 changes the contact position and the pressing force between a case where the sheet of paper S as the image formation target is uneven paper and other cases.

Accordingly, the contact position and the pressing force may be changed between a case where the sheet of paper is uneven paper and other cases.

Moreover, according to the present embodiment, in the case where the sheet of paper S as the image formation target is other than uneven paper, the controller 41 sets the contact position to the position P2, and in the case where the sheet of paper S is uneven paper, the controller 41 sets the contact position to the reference position P0 or the position P1 that is closer to the reference position P0 than the position P2 is.

Accordingly, at the time of forming an image on uneven paper, the contact position of the primary transfer roller 15 may be brought closer to the photoreceptor 11, and also, the pressing force may be reduced, compared to a case of forming an image on a sheet of paper other than uneven paper.

Furthermore, according to the present embodiment, when the contact position and the pressing force of the primary transfer roller 15 are changed, the controller 41 performs the image quality stabilization process for stabilizing an image quality.

Accordingly, an image quality, such as density of an image formed on the sheet of paper S, may be prevented from being changed by a change in the setting of the primary transfer roller 15.

Additionally, the embodiment to which the present invention may be applied is not limited to the embodiment described above, and a change may be made as appropriate within the scope of the present invention.

For example, although not particularly mentioned in the embodiment described above, the primary transfer roller 15 may be crown-shaped, with a middle portion between both end portions in a rotary shaft direction bulging more than the both end portions in a radial direction. For example, a diameter difference between the both end portions and the middle portion may be 100 μm or more.

In the case of the primary transfer roller 15 having such a shape, the end portions tend not to come into contact when the pressing force is 1 N, for example, compared to a case of the primary transfer roller 15 having a straight shape with no diameter difference, but the transfer property may be prevented from being deteriorated, by the control of the embodiment described above.

Furthermore, in the embodiment described above, the primary transfer roller 15 is controlled in such a way that the contact position and the pressing force may each be switched among three patterns, but a correspondence relationship between the contact position and the pressing force may be held in the form of a table or a graph, and control may be performed to determine the contact position according to the required pressing force. For example, it is also possible to perform control in such a way that the pressing force of the primary transfer roller 15 is determined in a manner capable of securing a sufficient secondary transfer property with respect to recessed parts of uneven paper, according to conditions regarding the surface roughness of the sheet of paper S, an amount of charge, environment, a developer history, and the like, and that the contact position where the primary transfer roller 15 and the photoreceptor 11 come into contact with each other by the determined pressing force of the primary transfer roller 15 is determined from the table or the graph.

Furthermore, an image may be formed on a sheet of paper S which is partially embossed, instead of being entirely embossed.

In this case, when the sheet of paper S as the image formation target is a sheet of paper with a partially uneven surface, the controller 41 may perform control of changing the settings regarding the contact position and the pressing force of the primary transfer roller 15 during image formation. Specifically, an embossed range of the sheet of paper S is specified by a user or detected by an optical sensor or the like, and an image may be formed by stopping conveyance of the sheet of paper S at a boundary of the embossed range and another range, and then, restarting conveyance of the sheet of paper S after changing the pressing force and the contact position.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-095018, filed on 17th of May, 2018, is incorporated herein by reference in its entirety.

What is claimed is:

1. An image forming device of an intermediate transfer method of transferring a toner image formed on an image carrier to a sheet of paper through an intermediate transfer body, the image forming device comprising:

a transfer roller which is disposed facing the image carrier across the intermediate transfer body, and which forms a nip part with the image carrier;

a movement mechanism which moves the transfer roller in a direction along a movement direction of the intermediate transfer body;

a pressure varying mechanism which changes a pressing force of the transfer roller on the intermediate transfer body; and a hardware processor which controls the movement mechanism and the pressure varying mechanism, and which sets a contact position and the pressing force of the transfer roller on the intermediate transfer body based on paper information of the sheet of paper as an image formation target.

2. The image forming device according to claim 1, wherein the hardware processor switches the contact position and the pressing force between a case where the sheet of paper as the image formation target is uneven paper and a case where the sheet of paper is other than the uneven paper.

3. The image forming device according to claim 1, wherein the hardware processor controls the movement mechanism, and sets the contact position in a range between a first position where a straight line joining a rotation center of the transfer roller and a rotation center of the image carrier is perpendicular to the intermediate transfer body and a second position that is on a downstream side of the first position by a predetermined distance in the movement direction of the intermediate transfer body, and controls the pressure varying mechanism, and reduces the pressing force as the contact position is brought closer to the first position from the second position.

4. The image forming device according to claim 3, wherein the hardware processor causes the contact position to be at the second position, in a case where the sheet of paper as the image formation target is other than uneven paper, and causes the contact position to be at the first position or a predetermined position that is closer to the first position than the second position is, in a case where the sheet of paper as the image formation target is the uneven paper.

5. The image forming device according to claim 1, wherein the transfer roller is crown-shaped, with a middle portion between both end portions in a rotary shaft direction bulging more than the both end portions in a radial direction.

6. The image forming device according to claim 1, wherein the hardware processor performs an image quality stabilization process for stabilizing an image quality, when settings regarding the contact position and the pressing force of the transfer roller are changed.

7. The image forming device according to claim 1, wherein, in a case where the sheet of paper as the image formation target is a sheet of paper with a partially uneven surface, the hardware processor changes settings regarding the contact position and the pressing force of the transfer roller during image formation on the sheet of paper.

8. A non-transitory computer readable storage medium storing a program which is executed by a computer of an image forming device of an intermediate transfer method of transferring a toner image formed on an image carrier to a sheet of paper through an intermediate transfer body, the image forming device including:

a transfer roller which is disposed facing the image carrier across the intermediate transfer body, and which forms a nip part with the image carrier, a movement mechanism which moves the transfer roller in a direction along a movement direction of the intermediate transfer body, and a pressure varying mechanism which changes a pressing force of the transfer roller on the intermediate transfer body, wherein the program causes the computer to perform controlling the movement mechanism and the pressure varying mechanism, and setting a contact position and the pressing force of the transfer roller on the intermediate transfer body based on paper information of the sheet of paper as an image formation target.

* * * * *